United States Patent [19]

Ramasco

[11] Patent Number: 4,558,491

[45] Date of Patent: Dec. 17, 1985

[54] COMBING MACHINE FOR TEXTILE FIBRES

[75] Inventor: Carlo Ramasco, Sesto Calende, Italy

[73] Assignee: Sant'Andrea Novara Officine Meccaniche e Fonderie S.p.A., Novara, Italy

[21] Appl. No.: 618,864

[22] Filed: Jun. 8, 1984

[30] Foreign Application Priority Data

Jun. 9, 1983 [IT] Italy ..... 53445/83[U]

[51] Int. Cl.[4] ..... D01G 19/06

[52] U.S. Cl. ..... 19/215; 19/229; 19/232

[58] Field of Search ..... 19/215, 220, 225, 218, 19/230, 231, 232, 235

[56] References Cited

U.S. PATENT DOCUMENTS 1,826,494 10/1931 Barker ..... 19/232 X

FOREIGN PATENT DOCUMENTS 640041 12/1936 Fed. Rep. of Germany ..... 19/229

*Primary Examiner*—Louis K. Rimrodt
*Assistant Examiner*—Judith L. K. Olds
*Attorney, Agent, or Firm*—Sughrue, Mion, Zinn, Macpeak & Seas

[57] ABSTRACT

A combing machine for textile fibres has a gill for combing a sliver of fibres, and at least two contrarotating tearing rollers for tearing successive tufts from the sliver of fibres as these are combed, the torn tufts being partially superimposed on each other to form a continuous combed web which is delivered to a conveyor belt. The tearing rollers are in direct contact with each other and are located upstream of the conveyor belt.

4 Claims, 2 Drawing Figures

COMBING MACHINE FOR TEXTILE FIBRES

The present invention relates to combing machines for textile fibres.

In particular the invention relates to a combing machine for textile fibres of the known type comprising:

means for combing a sliver of fibres, means for tearing successive tufts from the sliver of fibres as these tufts are combed, the tearing means including at least two contra-rotating tearing rollers, means for partially superimposing the torn tufts on each other so as to form a continuous combed web, and a conveyor belt by means of which the said combed web is conveyed continuously to the outlet of the machine.

According to the known art, one of the two tearing rollers is the drive roller at the loading end of the conveyor belt, while the other tearing roller presses on this with the interposition of the conveyor belt. Both the tearing rollers are constituted by grooved metal cylinders. The tearing roller which also serves as the drive roller for the conveyor belt is driven directly by the transmission of the machine while the other tearing roller is freely rotatably mounted and rotated by the conveyor belt.

The said known solution has the disadvantage of not always allowing gradual tearing of the tufts of fibre, and involving wear of the conveyor belt due to the fact that the latter participates in the tearing action.

The object of the present invention is to avoid these disadvantages.

In order to achieve this object, the invention provides a combing machine of the type specified above, characterised in that the tearing rollers are located upstream of the conveyor belt (with reference to the direction of advance of the sliver of textile fibres) and are in direct contact with each other.

Furthermore, the tearing rollers each have a rubber cladding and are both rotated by the transmission of the machine.

According to a further characteristic, one of the two tearing rollers is located above the conveyor belt, in correspondence with a return roller located at the loading end of with conveyor belt. The other tearing roller, located upstream of that disposed above the conveyor belt, is pressed upon by a metal roller of small diameter.

By virtue of this characteristic, the machine according to the invention allows gradual tearing of the combed tufts and at the same time avoids wear of the conveyor belt.

Since both the tearing rollers are driven directly by the transmission of the machine, relative sliding between these rollers is also avoided.

Figure 1:
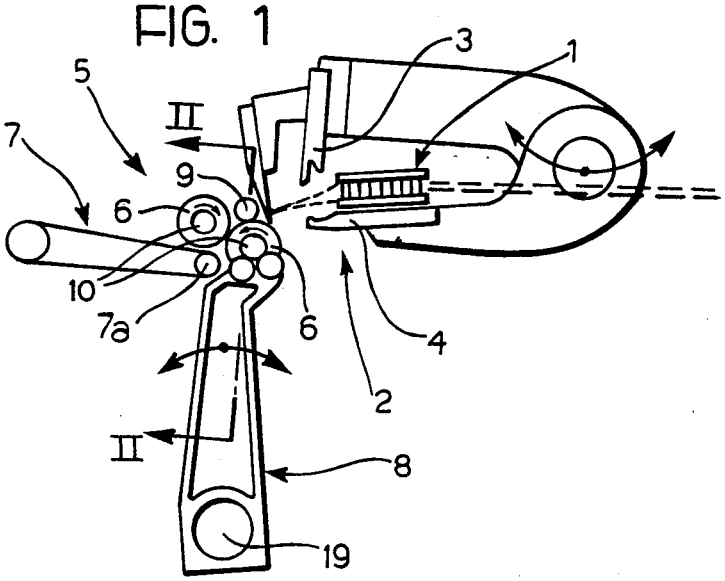
Figure 2:
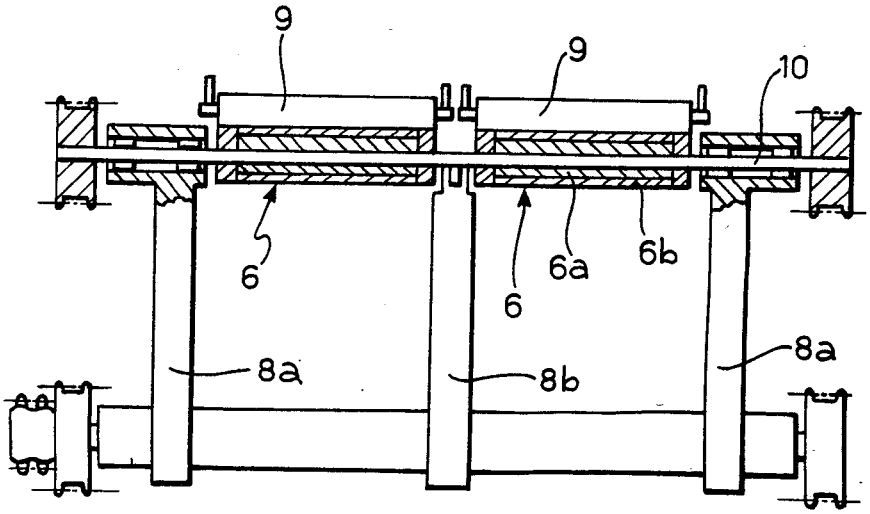

Further characteristics and advantages of the present invention will become apparent from the description which follows with reference to the appended drawings, provided purely by way of non-limiting example, in which:

FIG. 1 is a partial schematic side view of a combing machine for textile fibres according to the present invention, and FIG. 2 is a section on line II—II of FIG. 1.

FIG. 1 illustrates schematically part of a combing assembly of a combing machine for textile fibres. This assembly, of known type, includes a needle field 1, the so-called "gill", intended to effect a first straightening of the fibrous mass which is fed thereto in the form of a sliver. At the outlet from the gill is a gripper 2 formed by an upper jaw 3 and a lower jaw 4. For reasons of simplicity and clarity, the drawing does not illustrate the usual circular comb located below and downstream of the gripper, intended for combing the heads of the fibre tufts which project beyond the gripper from time to time.

Downstream of the combing assembly is a tearing assembly 5 including contra-rotating tearing rollers 6. These rollers, the shape and disposition of which is described below, are intended to tear successive tufts of fibres as these are combed, and to deposit them partially superimposed on each other so as to form a continuous combed web on a conveyor belt 7 which conveys the product to the outlet of the machine. The tearing rollers and the conveyor belt are carried by a carriage 8 of known type arranged to pivot about an axis 19.

As illustrated in FIG. 1, the tearing rollers 6 are located upstream of the conveyor belt (with respect to the direction of advance of the material) and are in direct contact with each other. One of these rollers is pressed down on the conveyor belt 7 in correspondence with the return roller **7*a* located at the loading end of the latter, while the other tearing roller 6 is located upstream of that pressing on the conveyor belt and is pressed upon in turn by a metal roller 9** of smaller diameter.

Each tearing roller 6 has a metal core **6*a* provided with a rubber cladding 6*b*. Furthermore both the tearing rollers 6** are driven by the transmission of the machine (not illustrated).

With reference to FIG. 2 the embodiment illustrated has a further characteristic which forms the subject of a copending Italian Utility Model Application filed by the same Applicants.

This characteristic lies in the fact that each support shaft of the tearing rollers 6 (indicated by reference numeral 10 in FIG. 2) is in its turn rotatably supported by arms **8*a* of the pivoted carriage 8 both at its ends and at an intermediate zone by arm 8*b* and in that each support shaft 10 carries a pair of tearing rollers 6 of the type described above side by side. In this solution, naturally two metal rollers 9 are provided which cooperate with respective tearing rollers, as illustrated in FIG. 2**. The said solution also allows a high production capacity to be obtained for the machine, in that it allows the working of relatively wide slivers of fibre without the risk of bending of the support shafts for the tearing rollers.

I claim:

1. A combing machine for textile fibres, comprising:

means for combing a sliver of fibres;

means for tearing successive tufts from the sliver of fibres as these tufts are combed, the tearing means including at least two contra-rotating tearing rollers;

means for partially super-imposing the torn tufts on each other so as to form a continuous combed web, and a conveyor belt for conveying the said combed web continuously to the outlet of the machine, wherein the improvement consists in said tearing rollers being in direct contact with each other and located upstream of the conveyor belt with reference to the direction of advance of the sliver of fibres.

2. Combing machine as defined in claim 1, wherein each of said tearing rollers has a rubber cladding.

3. Combing machine as defined in claim 2, wherein the conveyor belt has a return roller at the loading end of the belt and wherein one of the two tearing rollers is disposed above the conveyor belt in correspondence with said return roller at the loading end of the conveyor belt.

4. Combing machine as defined in claim 3, wherein the tearing roller which is located above the conveyor belt is disposed slightly downstream of the other tearing roller, and including a metal roller pressing on the said other tearing roller.

* * * * *